US006193846B1

(12) United States Patent
Lelmu

(10) Patent No.: US 6,193,846 B1
(45) Date of Patent: Feb. 27, 2001

(54) METHOD AND A SYSTEM IN A PAPER WEB FINISHING MACHINE OF EQUIVALENT

(75) Inventor: Juha Lelmu, Turku (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/245,091

(22) Filed: Feb. 5, 1999

(30) Foreign Application Priority Data

Feb. 9, 1998 (FI) ..... 980284

(51) Int. Cl.[7] ..... D21F 1/32; D21F 1/00
(52) U.S. Cl. ..... 162/199; 162/272
(58) Field of Search ..... 162/199, 272; 15/300.1, 301, 345, 346, 322, 330, 405, 415.1

(56) References Cited

U.S. PATENT DOCUMENTS 4,019,953 4/1977 Nystrom .
4,364,147 12/1982 Biedermann et al. .
5,635,031 6/1997 Enkvist .

*Primary Examiner*—Stanley S. Silverman
*Assistant Examiner*—Dionne A. Walls
(74) *Attorney, Agent, or Firm*—Nixon & Vanderhye P.C.

(57) ABSTRACT

A method and a system in a paper web finishing machine or equivalent, for controlled discharge of air which surrounds the machine and which contains impurities or steam. A first air curtain extending from the first side of the machine to its second side is generated above the machine so that the first air curtain drags along air which surrounds the machine and contains impurities or steam, to the second side of the machine where the air is exhausted. On the second side of the machine air can be blown by at least one second air jet so that a second upper air curtain is generated above the first air curtain with a direction mainly opposite to that of the first air curtain. Alternatively, a suction box may be positioned with respect to the machine for guiding and discharging the tail of the first air curtain.

25 Claims, 4 Drawing Sheets

METHOD AND A SYSTEM IN A PAPER WEB FINISHING MACHINE OF EQUIVALENT

BACKGROUND AND SUMMARY OF THE INVENTION

The present invention relates to a method and a system in a paper web finishing machine or equivalent, the method and system being defined in the preambles of the independent claims presented below.

The present invention relates particularly to a method and a system in a paper web finishing machine or a corresponding machine, such as in a paper roll unwinding machine, in a calender or in a machine stack, so that the air which surrounds the machine and which contains impurities and/or steam can be discharged in a controlled manner.

There is formed fine dust around finishing machines, for instance in paper roll unwinding machines, which dust is easily carried to other parts of the machine room by the upwards flowing air flows generated by the heat of the machines and/or paper. The impurities reduce the ambient air quality and may cause problems in machines and equipment, and therefore they should be prevented from entering the air in the machine room.

In order to solve this problem the U.S. Pat. No. 5,635,031 proposes to generate above the machine an air curtain which extends from the tending side of the machine to the drive side of the machine so that the air curtain sucks dusty air surrounding the machine to the drive side of the machine, where the dusty air and the air generating the curtain are discharged through an outlet opening arranged at the floor level. Additional air jets are simultaneously blown on the drive side in order to control the air curtain. The additional air jets, which partly have the same direction as the air curtain, are directed from the top obliquely downwards towards the air curtain. Their purpose is to turn the tail of the air curtain downwards at the machine's drive side.

Now it has turned out in this previously known solution that in addition to the dusty air a very large quantity of clean air is carried to the drive side of the machine, from where it must be removed.

In the previously known solution the first air curtain drags along both dusty air from beneath the curtain and clean air from the machine room above the air curtain. The air jets blown from the drive side towards the air curtain increase the quantity of air to be circulated, and in addition they drag along air from the machine room towards the discharge opening for dirty air arranged on the drive side. The removal of all this dusty air and clean air from the drive side requires large-sized ducts and a relatively high fan energy consumption. Of course circulation of a large quantity of clean air should be avoided, also because in addition to voluminous ducts and fans a large quantity of air require large equipment for their cleaning before they are returned to the machine room or discharged into the environment. It would be conceivable to reduce the air flows by decreasing the velocity and volume flow of the air jets generating the air curtain, but then there is nevertheless a risk in that the air curtain when heated begins to flow upwards and not in a controlled path over the machine towards the discharge opening, and thus the air curtain does not appropriately prevent the dusty air from spreading into the machine room.

If the air discharge opening or openings are not dimensioned to be sufficiently large, then a part of the air flowing downwards on the drive side will turn away from the discharge opening and under the machine, raising dust from the floor into the air and thus increasing the quantity of impurities in the air. An air flow beneath the machine has been found to be particularly inconvenient in an unwinding machine for thin paper, such as tissue paper, where the paper web is moved forwards close to the floor level. An air flow directed beneath the machine causes flutter in the tissue paper, which in turn causes runnability problems in the machine. One solution to this problem would be to dimension the discharge ducts, the fans and the air cleaning equipment substantially bigger, so that the total quantity of air can be removed through the discharge openings. However, this would increase the costs and would also require more space.

Particularly steam emissions cause inconvenience in calenders. The steam emissions increase when speeds in paper machines and thus also in on-line calenders increase, because the quantity of steam brought to the paper surface and thus leaking from the calender is constant per paper square meter. An on-line calender leaks steam in a quantity which may be even more than the double compared to traditional calenders. Due to this the humidity in the machine room increases substantially. In order to remove the humidity it is necessary to increase the ventilation, which is expensive.

The object of the present invention is therefore to provide an improved method and a system where the above mentioned problems are minimised in a paper web finishing machine or equivalent.

The object is particularly to provide a method and a system which avoid the recirculation of an excessive quantity of air.

A further object is to provide a method and a system which avoid inconvenient air flows in the vicinity of the machine.

An object is also to provide a method and a system which can reduce the leaking of steam, for instance from a calender into the air of the machine room.

An object is thus also to provide a method and a system with which the air curtain arranged above the machine can be guided in a controlled manner.

In order to attain the above mentioned objects the method and the system according to the invention are characterised in what is defined in the characterising clauses of the independent claims presented below.

Now it was surprisingly found that the above mentioned problems for instance in a paper roll unwinding machine can be solved by arranging a second shorter air curtain above the first air curtain generated over the machine from the tending side to the drive side, so that the direction of the second air curtain is mainly opposite to that of the first air curtain. It was found that a second air curtain with an opposite direction will in a clearly better way than previously prevent the first air curtain from rising upwards at its tail end, even though the second air curtain would have a very low velocity, even <0.5 m/s, and a high tendency to rise upwards. At the same time it was found that the upper air curtain prevents clean air from the environment from being dragged along the tail end of the first air curtain. The clean air of the upper air curtain is directed, differently than previously, into a different direction than the air of the first air curtain, and thus the mainly clean air of the second air curtain does not substantially mix with air which contains impurities, and thus it is not necessary to recycle the clean air via air ducts and air cleaning equipment back to the machine room.

The first air curtain is typically generated with a blowing device, such as blow beam, which is arranged above the machine in front of the tending side, and whose length is generally about the same as that of the machine, whereby the blowing device in a solution according to the invention is provided with

- a slot nozzle with a length mainly equal to that of the machine and having a slot width $b_1$<15 mm, or
- a plurality of slot and/or orifice nozzles arranged one after another in the machine direction and having slot widths $b_1$<15 mm and an orifice diameter between 10 and 40 mm, or
- a plurality of separate blow nozzles arranged one after another in the machine direction and having a nozzle diameter between 20 and 40 mm.

Thus, instead of a single long blowing device, it is also possible to mount a plurality of shorter blowing devices one after another in the machine, so that each blowing device covers a desired area of the machine. The length of a paper roll unwinding machine is typically about 10 to 40 m, whereby a plurality of blowing devices can be advantageously installed one after another above the tending side of the machine covering this distance, so that they can provide a suitable air curtain to cover a desired area of the machine. Correspondingly, in a solution according to the invention, a second blowing device or second blowing devices is/are arranged on the other side of the machine, on the drive side, and above the level of the first air curtain, for generating a second air curtain which covers a part of the first air curtain on the drive side of the machine. The second curtain covers according to the present invention about 20–50% of the length of the first curtain.

The second air curtain is advantageously generated about 1 to 2 m above the first air curtain so that it travels in a mainly horizontal plane, or in a plane which deviates at most 10° from the plane of the first air curtain.

The first air curtain is advantageously generated about 1 to 2 m above the machine and blown generally horizontally so that it extends from the first side of the machine to its second side, whereby the length of the air curtain in a typical application is about 8 to 10 m. When required the first air curtain can be blown slightly obliquely, or so that it deviates from the horizontal plane, from the first side of the machine to the second side. The second air curtain is blown in the opposite direction, i.e. so that it travels in a plane mainly parallel to, or almost parallel to the first curtain, but in the opposite direction.

The first air curtain (curtains) is (are) generated by air jets having a velocity and volume flow being such that the kinetic energy of the air jets is sufficient in order to carry the air curtain over the machine. However, in a solution according to the invention the air jets are dimensioned so that the jet velocities in the direction of the blow are at the second side of the machine almost zero, or at least <0.5 m/s, whereby the air jets can be easily guided downwards on the drive side into the desired direction towards the discharge opening, due to the effect of the second air curtain and the suction of the discharge opening. In this way it is possible to avoid the problem related to an air curtain arriving at a high velocity whereby the air jet (jets) is dispersed as it strikes with a strong force the wall defining the drive side and thereby flows in an uncontrolled way carrying away dusty air, also upwards into the clean air of the machine room. Then also an air flow along the floor is avoided, and its disturbing effect on the web flow, affecting the runnability of the machine, is avoided.

Above reference was mainly made to an air curtain crossing the machine, or travelling at a right angle to the machine direction. An air curtain of this kind typically travels horizontally, even if it, of course, can, if desired, travel obliquely upwards or downwards. In other applications, the air curtain can, however, be arranged to travel in the machine direction, in the web direction or against the web direction. In these other applications the air curtain typically travels perpendicularly or obliquely upwards. An upward travelling air curtain of this kind can be arranged for instance in connection with a calender to provide an air curtain in front of the stack of calender rolls, to prevent steam from freely escaping into the machine room. The air curtain is generated by blowing air jets from a blowing device, which is arranged at a small distance from the lowermost calender rolls and arranged to blow air jets obliquely upwards towards the upper part of the calender. The air curtain guides the steam escaping from around the calender rolls towards the upper part of the calender, where, according to the invention, a suction box or a corresponding device may be installed in order to guide in a controlled manner the tail end of the air curtain and remove air which contains steam.

A suction box or equivalent extending over the web at the top of the calender may be arranged to remove air from two directions, both from the inlet side and the outlet side of the calender. Further, when desired, the suction box or equivalent can be provided with projections in the machine direction, for instance above the edges of the web, whereby suction can be arranged at those places where the steam rises upwards in the calender.

With the aid of an air curtain and/or a suction box it is possible to turn the direction of the steam rising upwards from the calender so that the steam travels towards the suction slot of the suction box and is sucked into the box.

BRIEF DESCRIPTION OF THE DRAWINGS

The invention is described in more detail below with reference to the enclosed drawings, in which.

DETAILED DESCRIPTION OF THE DRAWINGS

Figure 1:
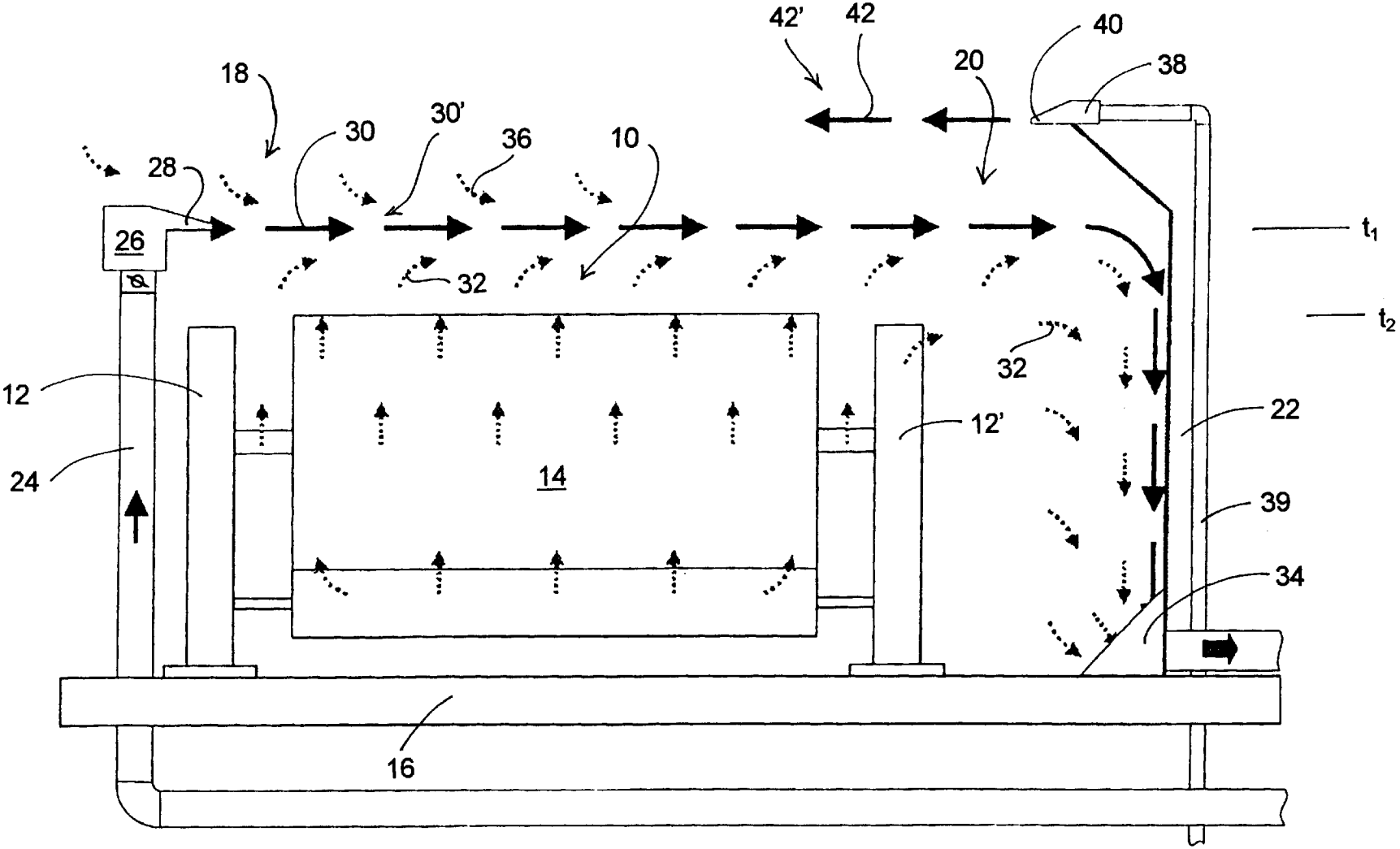
FIG. 1 shows a schematic cross-section of a finishing machine, including a system according to the invention.

FIG. 1 shows schematically in a transversal section a paper roll unwinding machine 10, to which is added a system according to the invention in order to lead away the air which surrounds the machine and contains impurities. The unwinding machine comprises a frame structure 12, 12', which supports the paper roll to be unwound. The frame structure 12, 12' is arranged on the floor level 16. The machine 10 has a tending side 18 and a drive side 20. The drive side is limited by the wall 22.

On the tending side 18 of the machine a system according to the invention comprises a duct 24 and a blowing device 26 connected to it, whereby the blowing device is arranged to blow from its slot nozzle and/or orifice nozzle 28 mainly horizontal air jets 30 in the transversal direction of the machine from tending side 18 of the machine up to its drive side 20. The air jets form an air curtain 30' on the level $t_1$, which is about 1 to 2 m above the top level $t_2$ of the machine or a roll located in the machine.

In the machine direction there may be one or more blowing devices 26. Each blowing device may have one or more slot and/or orifice nozzles one after another, from which the air is blown to generate a continuous air curtain above the machine. The air jets generate a mainly "tight" air curtain which prevents the air flows 32, which migrate upwards from the machine and contain impurities, from flowing through the air curtain and escaping into the machine room above the air curtain. These air flows 32 are "dragged along" by the air curtain and guided to the machine's drive side and towards the air discharge opening 34 in the lower part of the wall 22. At the same time the air curtain "drags along" some clean air, the air flows 36, from above the air curtain.

On the machine's drive side 20 there is a second blowing device 38 or a plurality of blowing devices arranged to be supported by the wall 22 and having nozzles 40 in order to blow air jets 42 towards the machine's tending side 18, mainly in the direction opposite to the first air jets 30. Air is supplied to the blowing device 38 via ducts 39. Said second air jets generate a second air curtain 42' about 1 to 2 m above the first air jets 30 and the air curtain 30' formed by them.

The second air curtain 42', which extends only a shorter distance over the transversal width of the machine towards the tending side 18, will prevent the first air curtain 30' from rising upwards when its velocity decreases. Thus the second air curtain guides the air jets 30 of the first air curtain 30' towards the wall 22 and from there further downwards along the wall towards the discharge opening 34.

At the same time the second air curtain 42' prevents the air flows 36 of the first one from joining the air curtain 30' above the machine's drive side, and thus it reduces the quantity of clean air travelling with the air curtain towards the discharge opening 34.

When the second air curtain 42' is arranged above the first air curtain 30' in order to prevent it from escaping upwards and away from the drive side, then the volume flow of the first air curtain can be reduced from that used previously, without allowing the air curtain and the dirty air flows 32 added to it to escape into the machine room. The second air curtain 42' generates a "ceiling", which prevents the upward flow of such small air flows, which due to the heat of the rolls 14 easily would begin to flow upwards.

By using the solution according to the invention it is possible:

- to reduce the quantity of the clean air of the first air curtain thanks to the second air curtain;
- to reduce the "absorption" of clean air flows 36 into the first air curtain, in other words, it is possible to reduce the secondary flow induced by the first air curtain; and
- to guide the clean air of the second air curtain away from the drive side of the machine.

In this way the total quantity of air, and particularly the quantity of clean air guided to the drive side can be substantially smaller than previously. A substantially smaller quantity of dusty air is guided to the drive side, a quantity which can be completely removed via the discharge opening on the drive side with the aid of ducts and fans of a reasonable size, in other words smaller than previously, and the removed air can be cleaned with the aid of devices which are smaller than previously. Thus a situation where air would circulate beneath the machine is also avoided, which otherwise would cause runnability problems.

Figure 2:
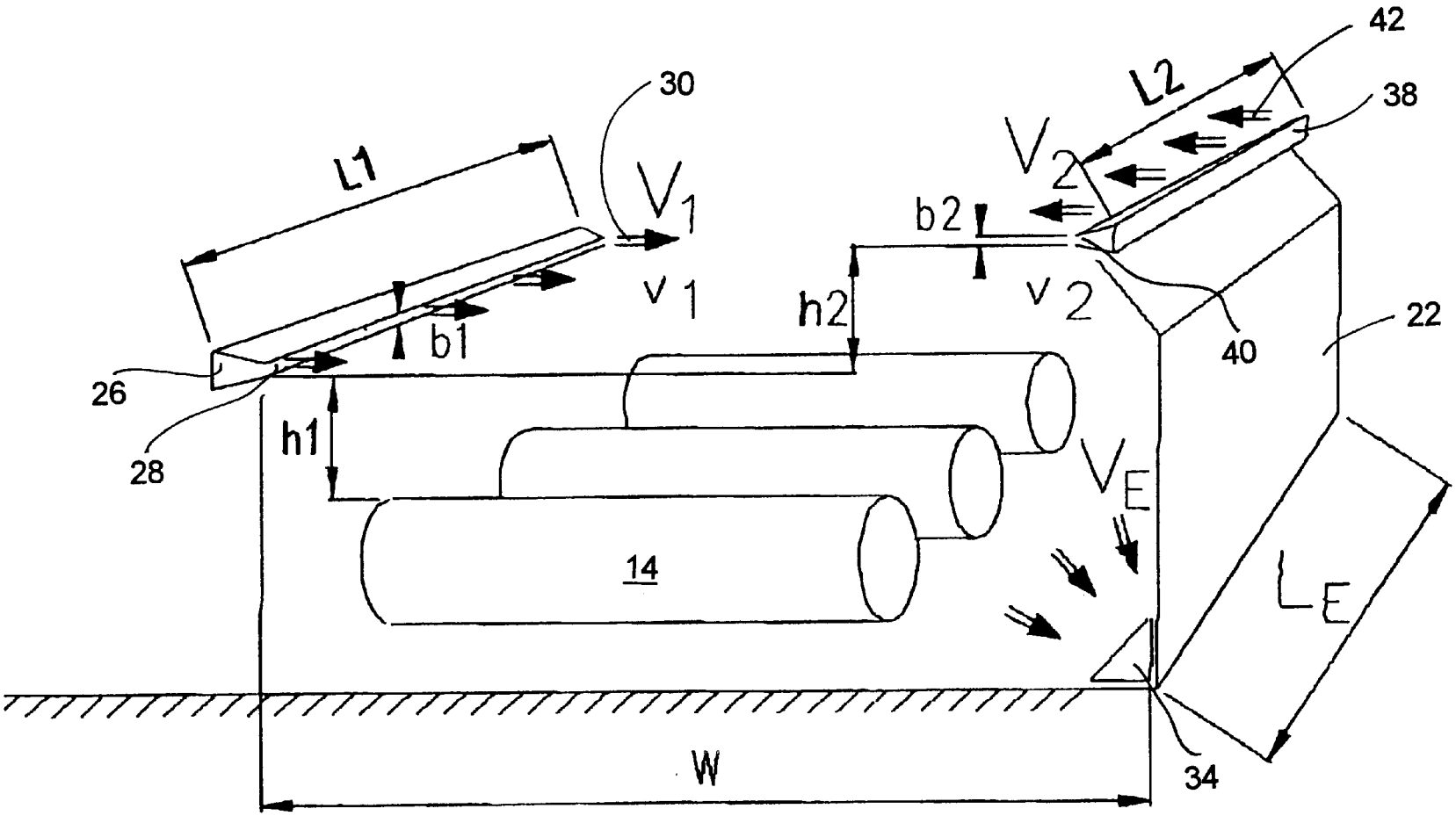
FIG. 2 shows schematically, as seen in an oblique front elevation, another finishing machine, including a system according to the invention.

FIG. 2 shows mainly the machine according to FIG. 1 and connected to it a system according to the invention which generates air curtains. The same reference numerals as in FIG. 1 are used in FIG. 2 where applicable. In the solution presented in FIG. 2 the first air curtain is generated by blowing air from slot nozzle 28 in the blowing device 26 with the length $L_1$ which is arranged on the tending side of the machine, whereby the nozzle width is $b_1$ (=height of the slot). The velocity of the air jets is $v_1$ and their volume flow is $V_1$. The air jets pass at a distance $h_1$ from the top surface of the paper rolls in the machine. The second air curtain with the opposite direction is generated by blowing air from the slot nozzle 40 in a blowing device 38 with the length $L_2$ which is arranged on the drive side, whereby the width of the slot is $b_2$ (=height of the slot). The velocity of the air jets is $v_2$ and their volume flow is $V_2$. The air jets pass at a distance $h_2$ from the first air curtain. A discharge opening 34 is formed in the lower part of the wall 22 on the drive side, whereby discharge air with a volume flow $V_E$ flows through this opening. The machine width is W. The machine width means here the distance from the nozzle 28 of the blowing device 26 on the tending side to the wall 22 on the drive side. The machine length L means here that part of the machine length which in the respective case is desired to be protected by an air curtain.

The first nozzles 28 are at a distance $h_1$ from the top of the paper roll or the machine. This distance is generally between 1 and 2 m, advantageously 1.1 to 1.5 m. The first air curtain should be arranged at such a level that it does not hit for instance a paper roll in the machine, which could cause inconvenient turbulence.

The second nozzles 40 are at a distance $h_2$ from the blow level of the first air curtain. This distance is generally between 1 and 2 m, advantageously between 1.2 and 1.7 m. The second air curtain should be arranged at such a distance from the blow level of the first air curtain that the first and second air curtains will not touch each other in an inconvenient manner, which could cause turbulence.

Figure 3:
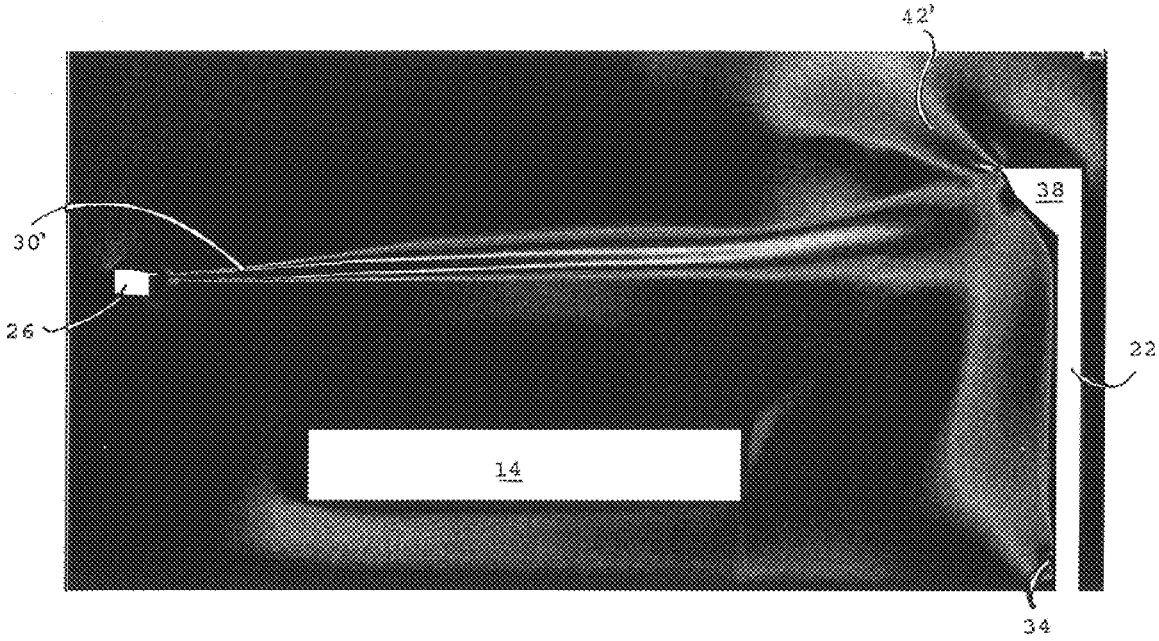
FIG. 3 shows the air flows around the finishing machine of FIG. 1 provided with a system according to the invention.

FIG. 3 shows simulated air flows around a finishing machine provided with a system according to the invention. FIG. 3 shows a paper roll 14 and first and second blowing devices 26, 38. An air curtain 30' projects as a narrow tongue from the first box 26 on the machine's tending side to the machine's drive side. The air jet velocity has a maximum at the centre of the tongue and decreases towards the sides of the tongue. FIG. 3 shows that the tongue almost comes to a halt before it reaches the wall 22 on the drive side. In a solution according to the invention the first air flow is advantageously adjusted to be such that the velocity of the air flow on the drive side, on the second side of the machine, is reduced to a velocity of about 0.5 m/s or below that.

The figure also shows a second air curtain 42', projecting from the second blowing device and being substantially shorter, which second air curtain extends over only about a third of the distance between the blowing devices 26, 28. The figure also clearly shows how the upper air curtain prevents the lower air curtain from rising upwards. Then the direction of the second air curtain changes from the horizontal to be directed slightly upwards. Thus when the air curtains meet they turn slightly away from each other. Then the upper, "lighter" air curtain turns more. The figure also clearly shows that on the drive side the first air curtain "flows" in a controlled manner towards the discharge opening 34 in the lower part of the wall.

The invention is particularly well suited to be applied in finishing machines for tissue paper qualities, as these qualities emit a lot of dust particles which should not reach the air in the machine room.

With a solution according to the invention the total air flow arriving at the drive side wall could be typically reduced almost by half, compared to the previous practices, whereby the discharge opening can swallow the total air flow. In practice the air flow is reduced for instance by reducing the slot of the nozzle 28 in FIG. 1 or 2 to one third. Then the velocity of the air curtain is increased and then even a small air flow, a "trickle", can cover the required area.

Figure 4:
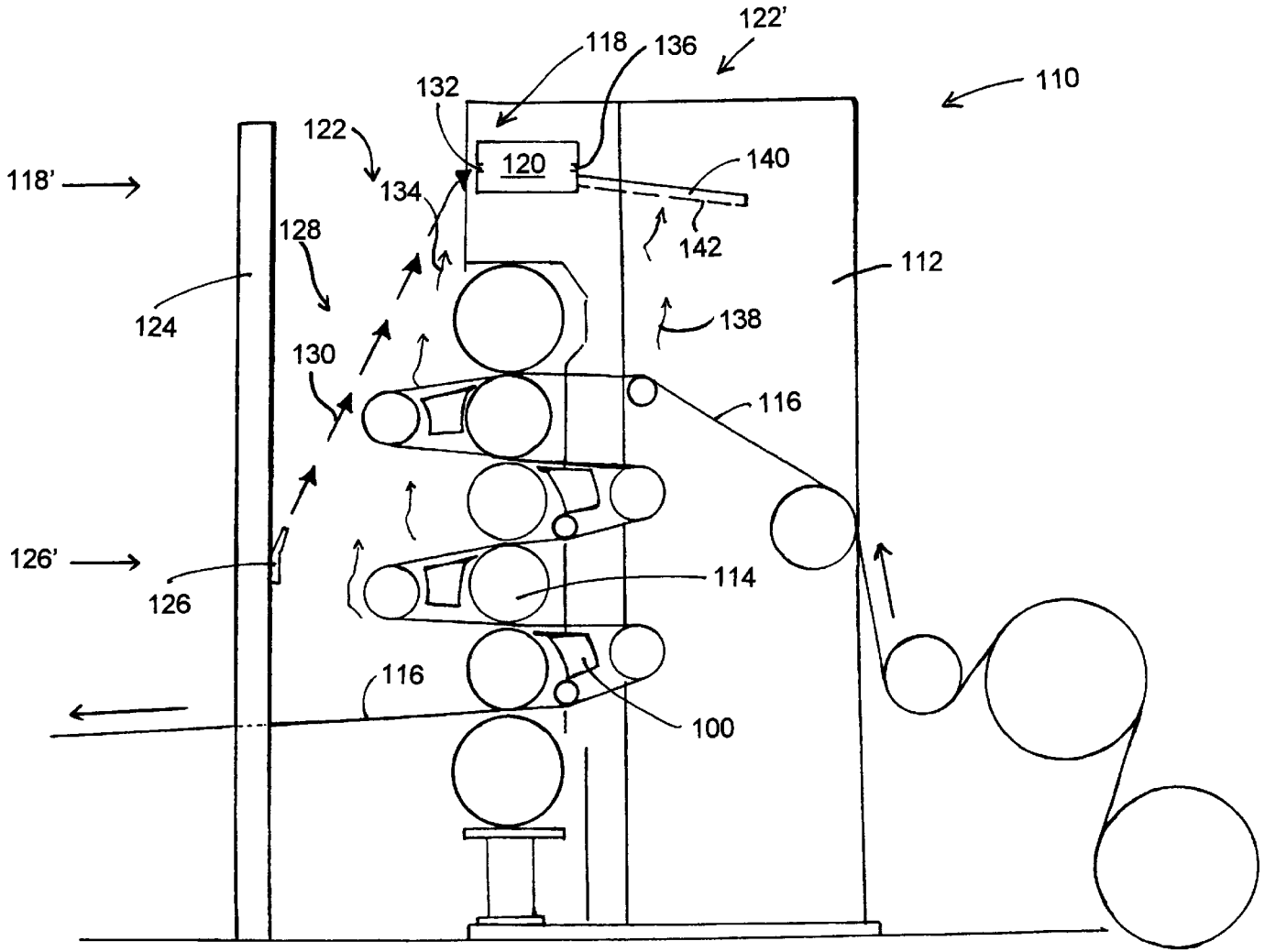
FIG. 4 shows a schematic cross-section of a calender including a system according to the invention.

FIG. 4 shows a calender 110, in a cross-section of the travelling direction of the web, where a system according to the invention is combined with the machine in order to lead away the air which rises from the calender and which contains steam and possible impurities. The calender comprises a frame structure 112, in which calender rolls 114 are arranged on top of each other, between which a paper web 116 is arranged to run. A suction box 120 is arranged across the machine at the top 118 of the calender frame structure.

On the outlet side 122 of the calender two vertical beams 124 are arranged at a short distance from the calender, one on each side of the web. A blowing device 126 is arranged on the vertical beams 124 across the machine in order to blow air jets 130 from a first level 126' obliquely upwards towards the suction box 120 at an other level 118' at the top 118 of the calender, so that the air jets generate an air curtain 128. The blowing device is advantageously arranged at a short distance above the paper web passing between the beams. The object is that the air, which contains steam and which rises from the calender, is guided towards the suction box in a controlled manner over the whole width of the web. Steam is brought to the web with steam boxes 100.

The suction box 120 has an inlet opening 132 opening towards the outlet side 122 of the calender. The air 134, which contains steam and which flows upwards from the calender, is guided in a controlled manner by the air curtain 128 and aided by the low pressure in the suction box towards this inlet opening 132 of the suction box. In the solution shown in FIG. 4 the suction box 120 has on its second opposite side a second inlet opening 136 which removes air 138 which contains steam and which rises upwards on the second inlet side 122' of the calender.

When the paper web passes back and forth through the calender, from its first inlet side 122' to its outlet side 122, it forms pockets from which the steam can escape, mainly only towards the sides of the machine. On the sides of the web the steam is mixed with air and rises upwards. Additional projections 140, shown by the dotted lines in FIG. 4, can be advantageously arranged at both ends of the suction box above the sides of the web, whereby the projections have suction openings 142 in order to remove this air, which contains steam and rises upwards on the sides of the machine.

There is no intention to limit the invention to the above presented embodiments which were described as examples, but the intention is to apply the invention widely within the scope defined in the claims presented below.

What is claimed is:

1. A method of controlling the environment around a machine which acts on a paper web, and has at least one of first and second sides, and first and second levels, said method comprising:

(a) generating a first air curtain which extends from at least one of the first side to the second side of the machine, and the first level to the second level, and which drags air containing at least one of impurities and steam from at least one of the first side to the second side and the first level to the second level, so that the dragged air containing at least one of impurities and steam is exhausted, and so that the first air curtain includes a tail end which contains at least one of impurities and steam; and (b) in a controlled manner guiding and discharging from the machine the first air curtain tail end, by generating a second air curtain above the first air curtain and directed from the second side of the machine toward the first side of the machine.

2. A method as recited in claim 1 wherein (a) is practiced to generate the first air curtain so that it is mainly horizontal and about 1 to 2 m above the essential top of the machine.

3. A method as recited in claim 1 wherein (a) is practiced by using a plurality of first air jets and operating the first air jets so that the velocity of air issuing therefrom is less than 0.5 m/s at the second side of the machine.

4. A method as recited in claim 1 wherein (b) is practiced to establish the second air current about 1–2 meters above the first air current, and wherein (a) and (b) are practiced so that the first and second air currents are in substantially parallel substantially horizontal planes.

5. A method as recited in claim 4 wherein the first air curtain has a length, and wherein (b) is practiced so that the second air curtain extends over the tail end of the first air curtain a distance which is about 20 to 50% of the length of the first air curtain.

6. A method as recited in claim 1 wherein the machine comprises a paper roll unwinding machine having a tending side as the first side thereof, and a drive side is the second side thereof, and wherein there are particulate impurities in the air surrounding the machine; and wherein (a) is practiced to establish a flow velocity of air from the tending side to the drive side which is less than 0.5 m/s at the drive side, and wherein (b) is practiced to guide the travel of the first air curtain horizontally or downwardly so as to reduce the absorption of air into the first air curtain from above.

7. A method as recited in claim 6 wherein (a) is practiced so that the flow velocity of air from the tending side to the drive side is substantially zero at the drive side.

8. A system for controlling the environment around a machine which acts on a paper web, and has at least one of first and second sides, and first and second levels, said system comprising:

means for generating a first air curtain which extends from at least one of the first side to the second side of the machine, and the first level to the second level, and which drags air containing at least one of impurities and steam from at least one of the first side to the second side and the first level to the second level, so that the dragged air containing at least one of impurities and steam is exhausted, and so that the first air curtain includes a tail end which contains at least one of impurities and steam; and means for, in a controlled manner, guiding and discharging from the machine the first air curtain tail end, comprising means for generating a second air curtain above the first air curtain and directed from the second side of the machine toward the first side of the machine.

9. A system as recited in claim 8 wherein said means for generating a first air curtain comprises a plurality of first air jets, and said means for generating said second air curtain comprises a plurality of second air jets.

10. A system as recited in claim 8 wherein said means for guiding and discharging comprises a suction box disposed on the second level of the machine in an upper part thereof.

11. A system as recited in claim 8 wherein said machine has a machine length in a machine direction, and wherein said means for generating said first air curtain comprises a slot nozzle having a length substantially the same as said machine length, and having a slot width of less than 15 mm.

12. A system as recited in claim 8 wherein said machine has a machine length in a machine direction, and wherein said means for generating said first air curtain comprises at least one of a plurality slot nozzles and orifice nozzles, any slot nozzles having a slot width of less than 15 mm, and any orifice nozzles having an orifice diameter of between 10–40 mm.

13. A system as recited in claim 8 wherein said machine has a machine length in a machine direction, and wherein said means for generating said first air curtain comprises a plurality of separate blowing nozzles arranged one after another in the machine direction, and having nozzle orifices with an orifice diameter of between 20–40 mm.

14. A system as recited in claim 8 wherein said means for generating said first air curtain establishes said first air curtain about 1 to 2 m above said machine, and wherein said means for generating said second air curtain establishes said second air curtain about 1 to 2 m above said first air curtain.

15. A system as recited in claim 8 wherein said machine comprises a drive side and has a floor level; and wherein said system further comprises: a wall limiting said drive side and against which said first air curtain is directed; and at least one discharge opening disposed in said wall adjacent said floor level for removing air from said drive side of said machine.

16. A system as recited in claim 10 wherein said machine comprises a calendar having a plurality of calendar rolls, a top, and an outlet, and through which a paper web travels; and wherein said means for generating a first air curtain comprises a blow box extending across the web and disposed on said outlet side of said calendar adjacent said calendar rolls and above the paper web, for blowing air in a direction obliquely upwardly toward said top of said calendar, and toward said suction box.

17. A system as recited in claim 16 wherein said suction box comprises a first side containing first inlet openings, and closest to said blow box, and a second side containing second inlet openings, and more remote from said blow box.

18. A system as recited in claim 17 wherein said suction box further comprises at said second side a projection extending away from said blow box, and a plurality of openings in said projection connected to said suction box.

19. A method of controlling the environment around a machine which acts on a paper web, and has at least one of first and second sides, and first and second levels, said method comprising:

(a) generating a first air curtain which extends from at least one of the first side to the second side of the machine, and the first level to the second level, and which drags air containing at least one of impurities and steam from at least one of the first side to the second side and the first level to the second level, so that the dragged air containing at least one of impurities and steam is exhausted, and so that the first air curtain includes a tail end which contains at least one of impurities and steam;

(b) in a controlled manner guiding and discharging from the machine the first air curtain tail end; and wherein (a) is practiced by using a plurality of first air jets and operating the first air jets so that the velocity of air issuing therefrom is less than 0.5 m/s at the second side of the machine.

20. A method of controlling the environment around a machine which acts on a paper web, and has at least one of first and second sides, and first and second levels, wherein the machine has a machine direction and a cross machine direction; said method comprising:

(a) generating a first air curtain which extends from at least one of the first side to the second side of the machine, and the first level to the second level, and which drags air containing at least one of impurities and steam from at least one of the first side to the second side and the first level to the second level, so that the dragged air containing at least one of impurities and steam is exhausted, and so that the first air curtain includes a tail end which contains at least one of impurities and steam;

(b) in a controlled manner guiding and discharging from the machine the first air curtain tail end; and wherein (a) is practiced to establish the first air curtain so that it is about 8 to 10 m long in the cross machine direction, and so that the volume flow of air is less than 0.4 cubic meters per second per meter in the machine direction.

21. A system for controlling the environment around a machine which acts on a paper web, and has at least one of first and second sides, and first and second levels, wherein said machine has a machine length in a machine direction; said system comprising:

means for generating a first air curtain which extends from at least one of the first side to the second side of the machine, and the first level to the second level, and which drags air containing at least one of impurities and steam from at least one of the first side to the second side and the first level to the second level, so that the dragged air containing at least one of impurities and steam is exhausted, and so that the first air curtain includes a tail end which contains at least one of impurities and steam;

means for, in a controlled manner, guiding and discharging from the machine the first air curtain tail end; and wherein said means for generating said first air curtain comprises a slot nozzle having a length substantially the same as said machine length, and having a slot width of less than 15 mm.

22. A system for controlling the environment around a machine which acts on a paper web, and has at least one of first and second sides, and first and second levels, wherein said machine has a machine length in a machine direction; said system comprising:

means for generating a first air curtain which extends from at least one of the first side to the second side of the machine, and the first level to the second level, and which drags air containing at least one of impurities and steam from at least one of the first side to the second side and the first level to the second level, so that the dragged air containing at least one of impurities and steam is exhausted, and so that the first air curtain includes a tail end which contains at least one of impurities and steam;

means for, in a controlled manner, guiding and discharging from the machine the first air curtain tail end; and wherein said means for generating said first air curtain comprises at least one of a plurality slot nozzles and orifice nozzles, any slot nozzles having a slot width of less than 15 mm, and any orifice nozzles having an orifice diameter of between 10–40 mm.

23. A system as recited in claim 22 wherein said machine has a machine length in a machine direction, and wherein said means for generating said second air curtain comprises at least one of a plurality slot nozzles and orifice nozzles, any slot nozzles having a slot width of less than 15 mm, and any orifice nozzles having an orifice diameter of between 10–40 mm.

24. A system for controlling the environment around a machine which acts on a paper web, and has at least one of first and second sides, and first and second levels, wherein said machine has a machine length in a machine direction; said system comprising:

means for generating a first air curtain which extends from at least one of the first side to the second side of the machine, and the first level to the second level, and which drags air containing at least one of impurities and steam from at least one of the first side to the second side and the first level to the second level, so that the dragged air containing at least one of impurities and steam is exhausted, and so that the first air curtain includes a tail end which contains at least one of impurities and steam;

means for, in a controlled manner, guiding and discharging from the machine the first air curtain tail end; and wherein said means for generating said first air curtain comprises a plurality of separate blowing nozzles arranged one after another in the machine direction, and having nozzle orifices with an orifice diameter of between 20–40 mm.

25. A system as recited in claim 24 wherein said machine has a machine length in a machine direction, and wherein said means for generating said second air curtain comprises a plurality of separate blowing nozzles arranged one after another in the machine direction, and having nozzle orifices with an orifice diameter of between 20–40 mm.

* * * * *

UNITED STATES PATENT AND TRADEMARK OFFICE

CERTIFICATE OF CORRECTION

PATENT NO. : 6,193,846 B1
DATED : February 27, 2001
INVENTOR(S) : Leimu

It is certified that error appears in the above-identified patent and that said Letters Patent is hereby corrected as shown below:

Title page,
(see Inventors' Declaration filed February 5, 1999)
Delete "(75) Inventor: Juha Lelmu, Turku (F1)" and insert therefor -- (75) Inventor: Juha Leimu, Turku (F1) --.

Signed and Sealed this

Fourth Day of September, 2001

*Attest:*

Nicholas P. Godici

*Attesting Officer*

NICHOLAS P. GODICI
*Acting Director of the United States Patent and Trademark Office*